US005961110A

United States Patent [19]

Adachi et al.

[11] Patent Number: 5,961,110

[45] Date of Patent: Oct. 5, 1999

[54] SHEET SORTER WITH SHEET JAM DETECTION

[75] Inventors: Seiichiro Adachi, Yokohama; Katsuhito Kato; Hitoshi Fujimoto, both of Kawasaki, all of Japan

[73] Assignee: Canon Kabushiki Kaisha, Tokyo, Japan

[21] Appl. No.: 08/432,595

[22] Filed: May 1, 1995

Related U.S. Application Data

[63] Continuation of application No. 08/222,869, Apr. 5, 1994, abandoned.

[30] Foreign Application Priority Data

Apr. 7, 1993 [JP] Japan ..... 5-080655

[51] Int. Cl.[6] ..... B65H 39/02; B65H 7/02

[52] U.S. Cl. ..... 270/58; 271/259; 271/265.01; 271/294

[58] Field of Search ..... 270/58; 271/258.01, 271/259, 265.01, 265.02, 287, 288, 289, 290, 292, 294, 296

[56] References Cited

U.S. PATENT DOCUMENTS

| | | | |
|---|---|---|---|
| 3,977,667 | 8/1976 | Cross et al. | 271/289 |
| 4,111,410 | 9/1978 | Tates et al. | 271/288 X |
| 4,273,326 | 6/1981 | Snellman et al. | 271/288 |
| 4,299,382 | 11/1981 | Ichikawa | 271/258 X |
| 4,449,812 | 5/1984 | Furuichi et al. | 271/294 X |
| 4,478,406 | 10/1984 | DuBois . | |
| 4,512,565 | 4/1985 | Matsumoto et al. | 271/293 X |
| 4,711,444 | 12/1987 | Geurts | 271/290 |
| 4,900,009 | 2/1990 | Kitahara et al. . | |
| 5,154,411 | 10/1992 | Saito et al. . | |
| 5,282,611 | 2/1994 | Ueda et al. . | |
| 5,382,016 | 1/1995 | Kobayashi et al. | 271/294 X |

FOREIGN PATENT DOCUMENTS

| | | | |
|---|---|---|---|
| 52357 | 5/1981 | Japan | 271/292 |
| 136476 | 6/1987 | Japan | 271/287 |

*Primary Examiner*—John E. Ryznic

*Attorney, Agent, or Firm*—Fitzpatrick, Cella, Harper & Scinto

[57] ABSTRACT

The present invention provides a sheet post-treatment apparatus comprising a sheet convey portion having a sheet path and a sheet discharge opening, and a sheet receiving tray portion having a plurality of sheet receiving tray means. Wherein a sheet is transferred between the sheet convey portion and the sheet receiving tray portion, and the sheet convey portion and the sheet receiving tray portion can be shifted relative to each other in an arrangement direction of the sheet receiving tray means whenever the sheet is transferred. Further, there is provided detection means for detecting the fact that the sheet exists between the sheet convey portion and the sheet receiving tray portion.

8 Claims, 10 Drawing Sheets

SHEET SORTER WITH SHEET JAM DETECTION

This application is a continuation of application Ser. No. 08/222,869, filed Apr. 5, 1994, now abandoned.

BACKGROUND OF THE INVENTION

1. Field of the Invention

The present invention relates to a sheet post-treatment apparatus which facilitate jam treatment, and more particularly, it relates to a sheet post-treatment apparatus for post-treating output copies discharged from an image forming apparatus such as a copying machine, a laser beam printer, a printing device and the like and successively sorted in a sheet receiving trays (referred to as "bins" hereinafter), and an image forming apparatus having such a sheet post-treatment apparatus.

2. Related Background Art

Conventionally, a sorter which is one of sheet post-treatment apparatuses serves to sort sheets discharged from an image forming apparatus in bins which are arranged side by side in a vertical direction or a horizontal direction, thereby obtaining a plurality of parts of copy bundles. In general, such a sorter comprises a sheet convey portion for conveying a sheet discharged from the image forming apparatus to the bins, and a bin portion including a plurality of bins on which the sheets are to be stacked.

In one of sheet sorting methods, the bins are selectively shifted to a discharge opening of the sheet convey portion (i.e. a sorter of so-called bin shift type). The bin portion and the sheet convey portion are fixedly arranged in proximity to each other so that they are not contacted with each other and are not separated from each other.

In the sorter of bin shift type, a position of the sheet conveyed in the sheet convey portion is always checked by a sensor or sensors. Further, the presence/absence of the sheet on the bin can be detected by a sensor attached to the bin portion. However, there was no means for ascertaining the fact that the sheet is correctly transferred from the convey portion to the bin portion. Thus, the conventional sorters had the following drawbacks.

If abnormal sheet convey occurs (for example, if the sheet is greatly curved or bent or if the sheet is skew-fed with respect to a sheet conveying direction during the conveyance of the sheet), the sheet discharged from the sheet convey portion will not be correctly rested on the bin so that, as shown in FIG. 8, the sheet is straddling between discharge rollers 501 of the sheet convey portion and the bin portion 502. In this condition, if the bin portion is shifted upwardly or downwardly, the sheet will enter into a clearance between the bin portion and the sheet convey portion, thereby causing the inconvenience (for example, the discharge opening of the sheet convey portion is closed by the sheet)(FIGS. 9 and 10).

If the discharge opening 502 is immediately closed by the sheet entered into the clearance, since a next sheet cannot be discharged through the discharge opening, the fact that the next sheet cannot be discharged is detected by a sensor (not shown) disposed in a sheet convey path of the convey portion, thereby informing the sorter of the abnormity. Consequently, the sorter and the image forming apparatus sending the sheet to the sorter are stopped, and an operator is informed of the fact that the sheet closing the discharge opening 502 should be removed. Since a distance between the bins in the proximity of the discharge opening 502 is wider than a distance between the bins in the other positions, the operator can relatively easily insert his hand between the bins and remove the sheet jammed in the proximity of the discharge opening. However, this sheet removing operation is troublesome in comparison with the normal jam treatment (in which a sheet jammed in the convey portion due to the poor sheet conveyance is removed), particularly for any operator having large hands.

Further, if the discharge opening of the convey portion is not immediately closed by the sheet S entered into the clearance between the convey portion and the bin portion, the sheet will be shifted to a position where the sheet cannot be easily removed (position S' shown in FIG. 9). That is to say, the sheet S straddling between the bin portion and the convey portion is shifted by the upward or downward movement of the bin portion or by being urged by the next sheet subsequently entering between the convey portion and the bin portion, with the result that the sheet is shifted to a position where the operator cannot easily access to the sheet. However, since the apparatus cannot ascertain the fact that the sheet exists in the abnormal position, the apparatus continues to operate. As a result, even if the fact that the sheet has entered between the bin portion and the convey portion is detected by the obstruction of the shifting movement of the bin portion due to the sheet jam and the sorter and the image forming apparatus sending the sheet to the sorter are stopped, it is impossible for the operator to remove the sheet S' thereby to restore the apparatus to the usable condition.

SUMMARY OF THE INVENTION

The present invention intends to eliminate the above-mentioned conventional drawbacks, and has an object to provide a sheet post-treatment apparatus and an image forming apparatus, which can detect the fact that a sheet is remaining between a sheet convey portion and a sheet receiving portion and in which jam treatment can easily be effected.

According to the present invention, for example, if the sheet enters between the sheet convey portion and bin portion of the sorter, the entering of the sheet is immediately detected by a sensor arranged out of a conveying path, with the result that the sorter and the image forming apparatus sending the sheet to the sorter are stopped, so that, before the sheet is shifted to a position where the sheet cannot easily be removed, the operator is informed of the fact that the sheet entered between the convey portion and the bin portion should be removed.

Further, in the sheet removing operation, since the convey portion or the bin portion can be rocked greatly to separate them from each other, the operator can easily remove the jammed sheet.

As mentioned above, since there is provided the detection means for detecting the fact that the sheet enters between the bin unit and the sheet convey unit, the fact that the sheet erroneously enters between the units can be ascertained. Consequently, the apparatus can be restored to the normal condition.

Further, since the bin unit and the sheet convey unit can be relatively separated from each other, even if the sheet enters between the bin unit and the convey unit (i.e. if the abnormal condition occurs), the apparatus can be restored to the normal condition without acting excessive load to the sorter.

DESCRIPTION OF THE PREFERRED EMBODIMENT

The present invention will now be explained in connection with embodiments thereof with reference to the accompanying drawings.

Figure 1:
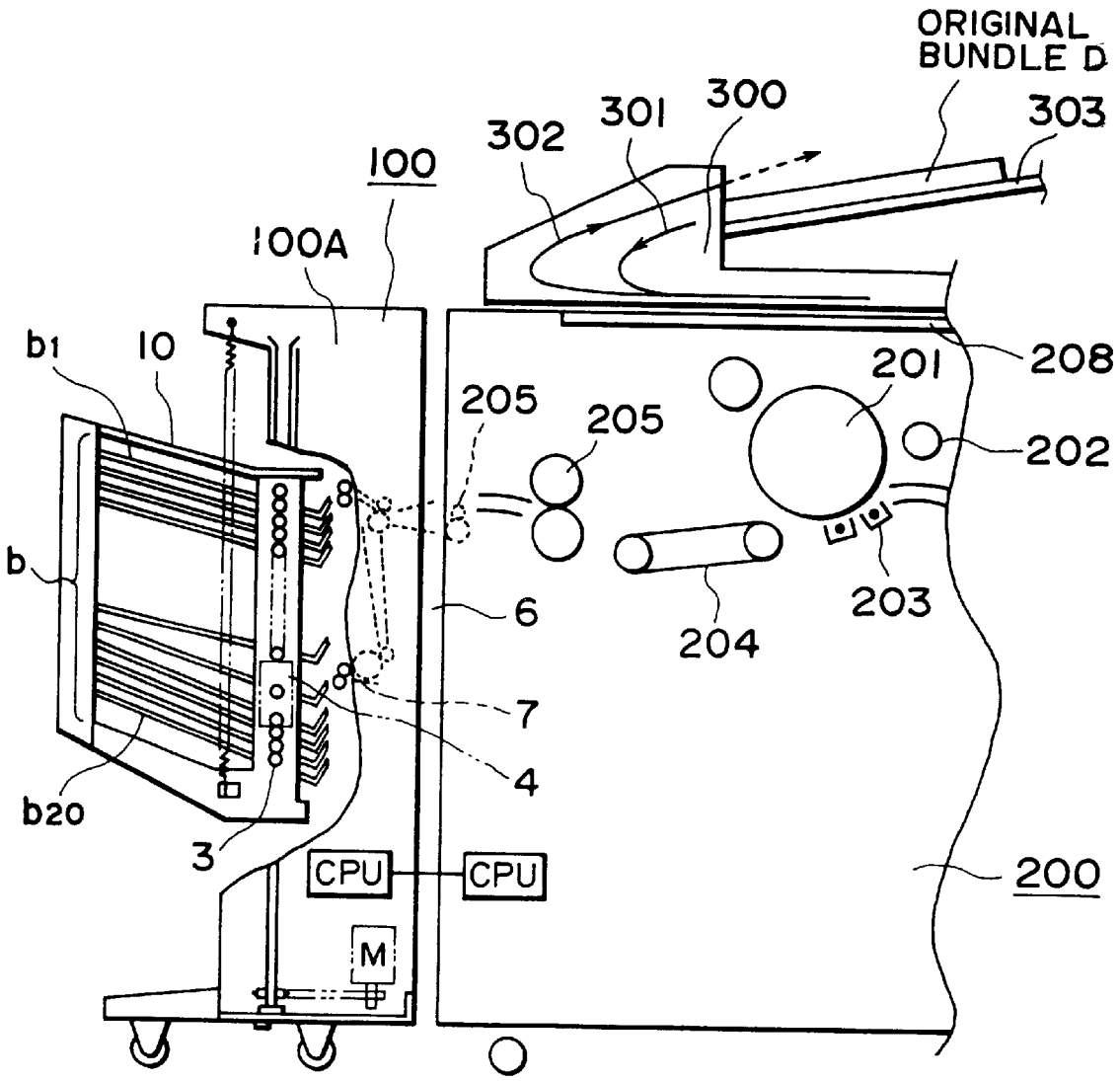
FIG. 1 is a partial sectional view of an image forming apparatus according to the present invention.
Figure 2:
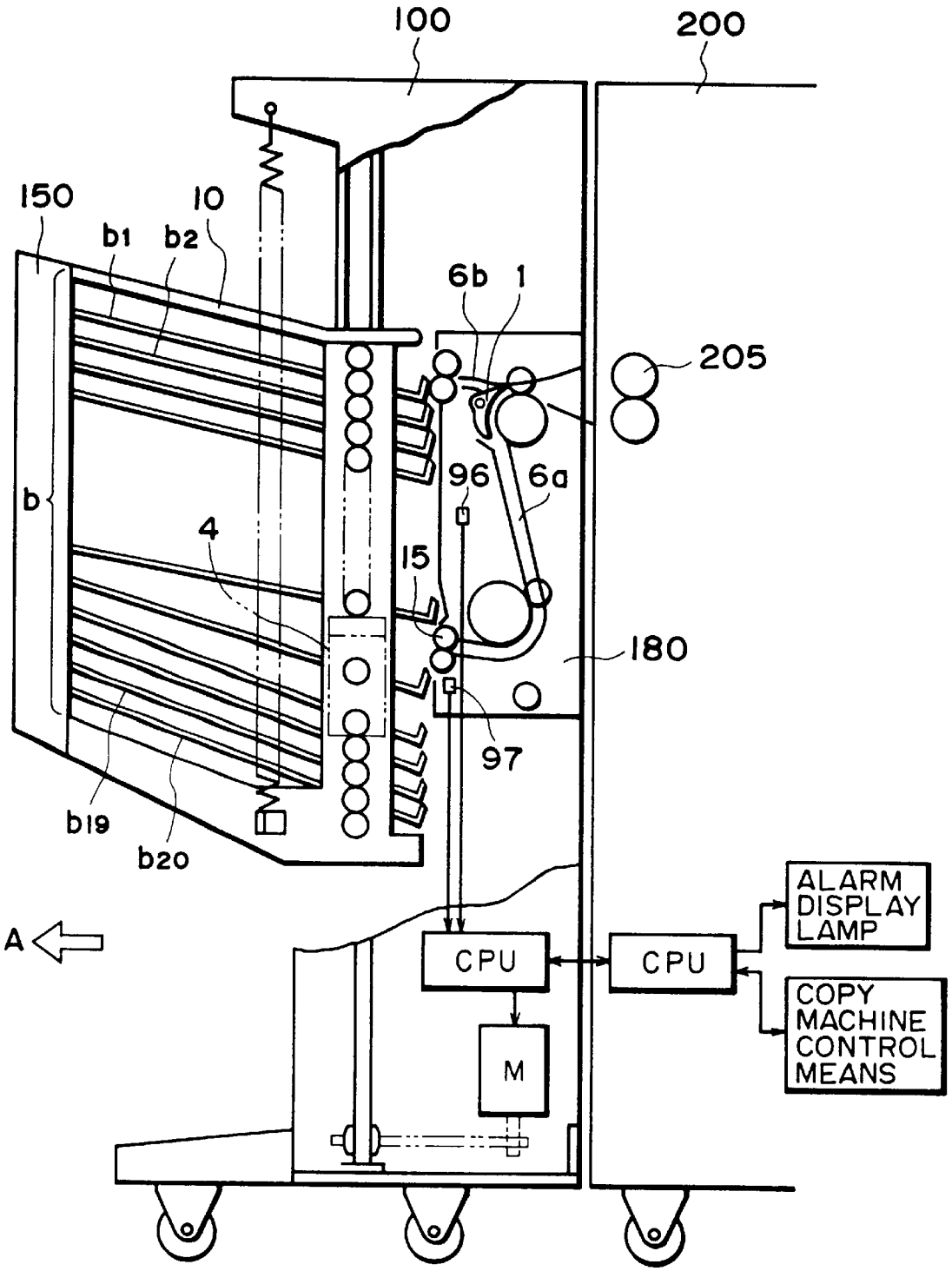
FIG. 2 is a sectional view of a sheet post-treatment apparatus according to the present invention.

FIG. 1 is a partial sectional view showing a construction of an image forming apparatus including a sheet post-treatment apparatus according to the present invention. An automatic original feed apparatus 300 for circulating originals is rested on an upper surface of an image forming apparatus 200, and a sorter 100 having twenty bin trays b (b1, b2 . . . , b19, b20) is arranged at a downstream side of the image forming apparatus. The sorter is removably connected to the image forming apparatus 200 so that the sorter can be separated from the image forming apparatus in a direction shown by the arrow A (FIG. 2). Since the image forming apparatus 200 is a conventional apparatus of electrophotographic type, detailed explanation thereof will be omitted. However, briefly explaining, the image forming apparatus is designed so that an image on an original rested on a platen glass 208 is focused on a photosensitive drum 201 by an optical system (not shown) to form a latent image which is then visualized by a developing means 202 as a toner image which is in turn transferred onto a sheet by a transfer electrode 203, and the sheet is then sent to a fixing device 205, where the toner image is permanently fixed to the sheet.

As shown in FIG. 2, the sorter 100 is of so-called bin shift type, and a bin unit 150 including a plurality of bin trays b arranged side by side in a vertical direction is supported by a body 100A of the sorter 100 for shifting movement in the vertical direction so that the bins can be lifted one by one by revolution of spiral cams 4 arranged at both ends of the body 100A.

The sheet S on which the image was formed by the image forming apparatus 200 is sent to the sorter 100 by means of a pair of discharge rollers 205. In the sorter 100, the sheet S is sent to the bin unit 150 through a convey unit 180 (having an outlet opening 180*a*). In the convey unit 180, the sheet S introduced from an inlet opening 180*b* is sent to a sort path 6*a* or a non-sort path 6*b* by a flapper 1. When a non-sort mode (wherein the sheets are not sorted) is selected, all of the sheets pass through the non-sort path 6*b* and are discharged onto a no-sort tray 10. On the other hand, a sort mode (wherein the sheets are sorted) is selected, the sheets are introduced into the sort path 6*a*, and the sheets discharged by a pair of discharge rollers 15 are accommodated in the bin trays b which can be lifted and lowered.

Figure 3:
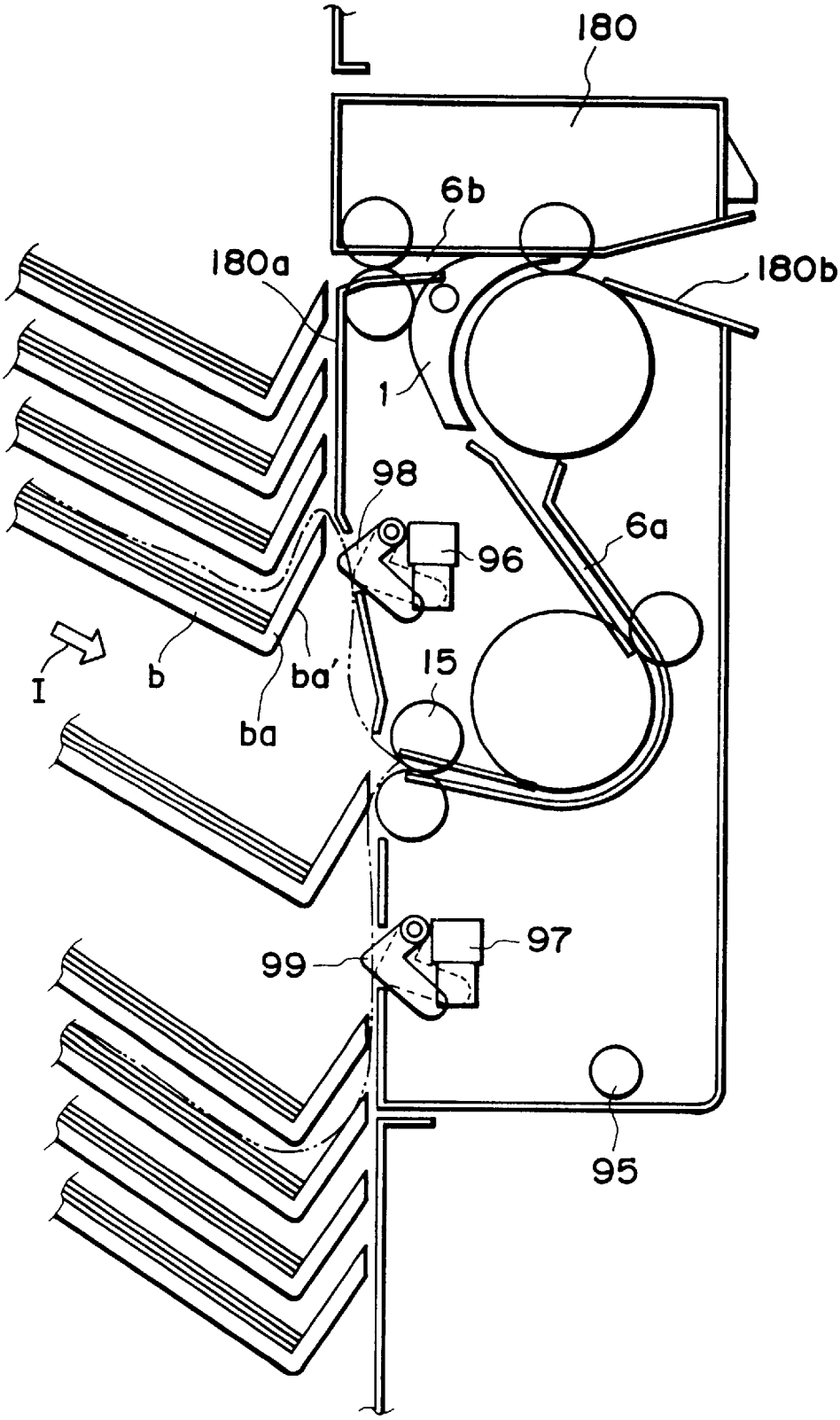
FIGS. 3 and 4 are enlarged sectional views of a convey unit and a bin unit of the sheet post-treatment apparatus according to the present invention.

As shown in FIG. 3, in the proximity of a discharge opening of the convey unit 180, sensor arms 98, 99 are protruded from the convey unit above and below the discharge opening, respectively. Even when a rear end portion of the sheet discharged from the sheet convey portion by the discharge rollers 15 is stopped while straddling between the convey unit 180 (for example, peripheral surfaces of the discharge rollers 15) and the bin tray b, the bin unit 150 is not stopped but can be shifted. When the bin unit is shifted upwardly, a front end portion of the sheet S entered into the bin unit is returned so that the rear end portion of the sheet enters between the bin unit 150 and the convey unit 180 (more particularly, into a clearance between an outer surface ba' of a tip receiving portion ba of the bin tray b and a side plate (outer wall) 180*a* of the convey unit 180). As a result, the sensor arm 98 is urged inwardly by the sheet S so that the sensor arm is detected by a sensor 96. At this point, the sorter 100 detects the fact that the sheet S is remaining between the bin unit 150 and the convey unit 180. Consequently, the sorter 100 and the image forming apparatus 200 sending the sheet to the sorter 100 are stopped.

On the other hand, when the bin unit 150 is shifted downwardly, the sheet S enters between the bin portion B and the convey unit 180. As a result, the sensor arm 99 is urged inwardly by the sheet S so that the sensor arm is detected by a sensor 97. In this way, the sorter 100 detects the fact that the sheet S is remaining between the bin unit 150 and the convey unit 180. Consequently, the sorter 100 and the image forming apparatus 200 sending the sheet S to the sorter 100 are stopped, and the operator is informed of the fact that the sheet remaining between the convey unit 180 and the bin unit 150 should be removed.

Figure 4:
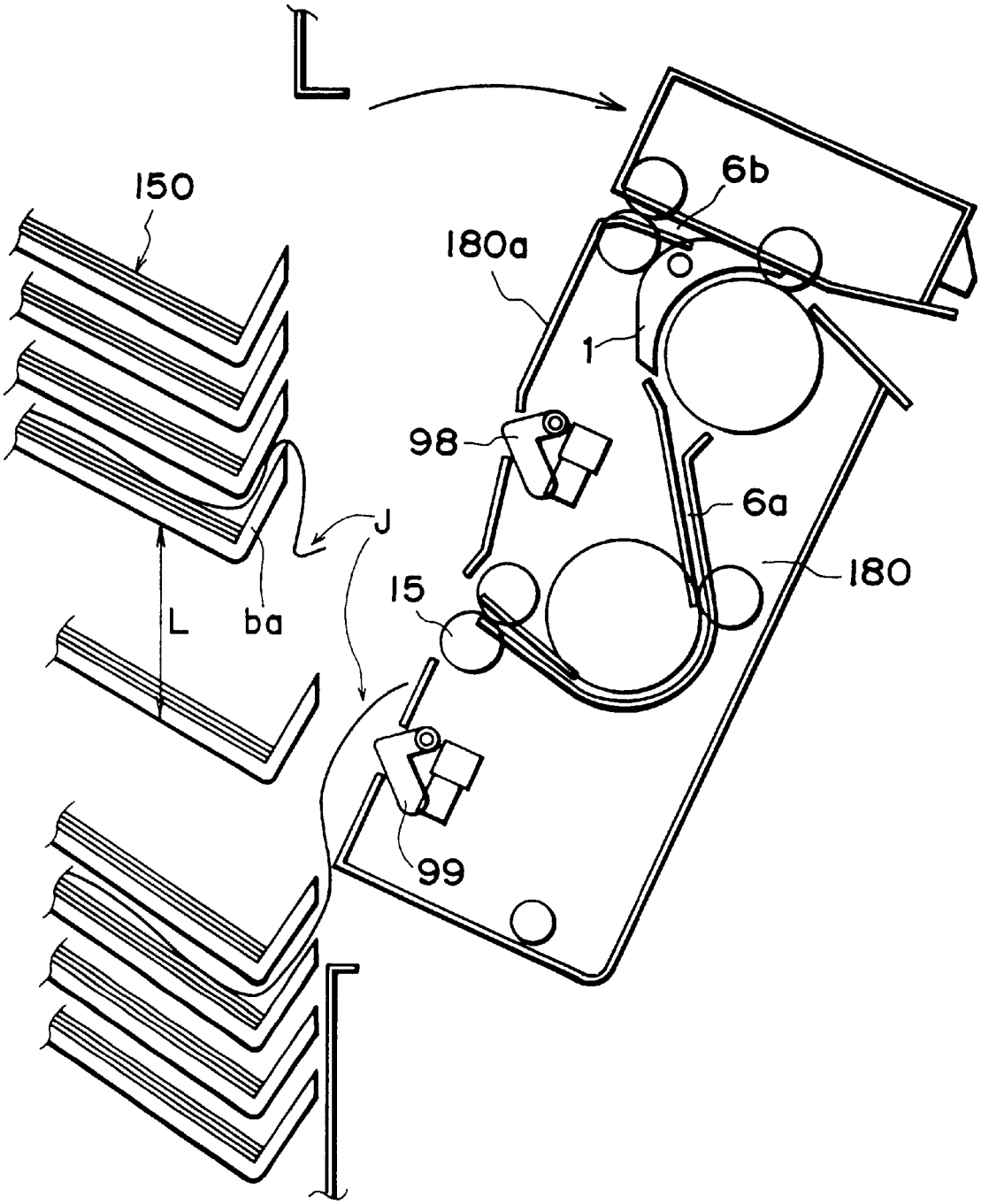

The convey unit 180 can be rocked with respect to the body 100A for rotational movement around a shaft 95. When the operator tries to remove the sheet entered between the bin portion and the convey portion, first of all, the sorter is separated from the image forming apparatus 200 and then the convey portion 180 is opened as shown in FIG. 4. In this way, the operator can easily remove the jammed sheet. Since a distance L between the bin trays in the bin unit 150 is wider in the proximity of the discharge opening opposed to the discharge rollers 15 (by which the sheet is discharged) than in the other positions, so long as the sheet is looked at from the outside of the bin b by the operator, the operator can insert his hand between the bins from a direction shown by the arrow I in FIG. 3 and remove the sheet jammed between the bin unit 150 and the convey unit 180.

However, if the presence of the sheet cannot be ascertained through the bins, the jammed sheet cannot be removed from the outside of the bins. In such a case, according to the illustrated embodiment, since the sorter can be separated from the image forming apparatus 200 and then the convey unit can be rocked, the jammed sheet can easily be removed from the inside of the bins (from a direction shown by the arrows J in FIG. 4).

Next, a second embodiment of the present invention will be explained.

Figure 5:
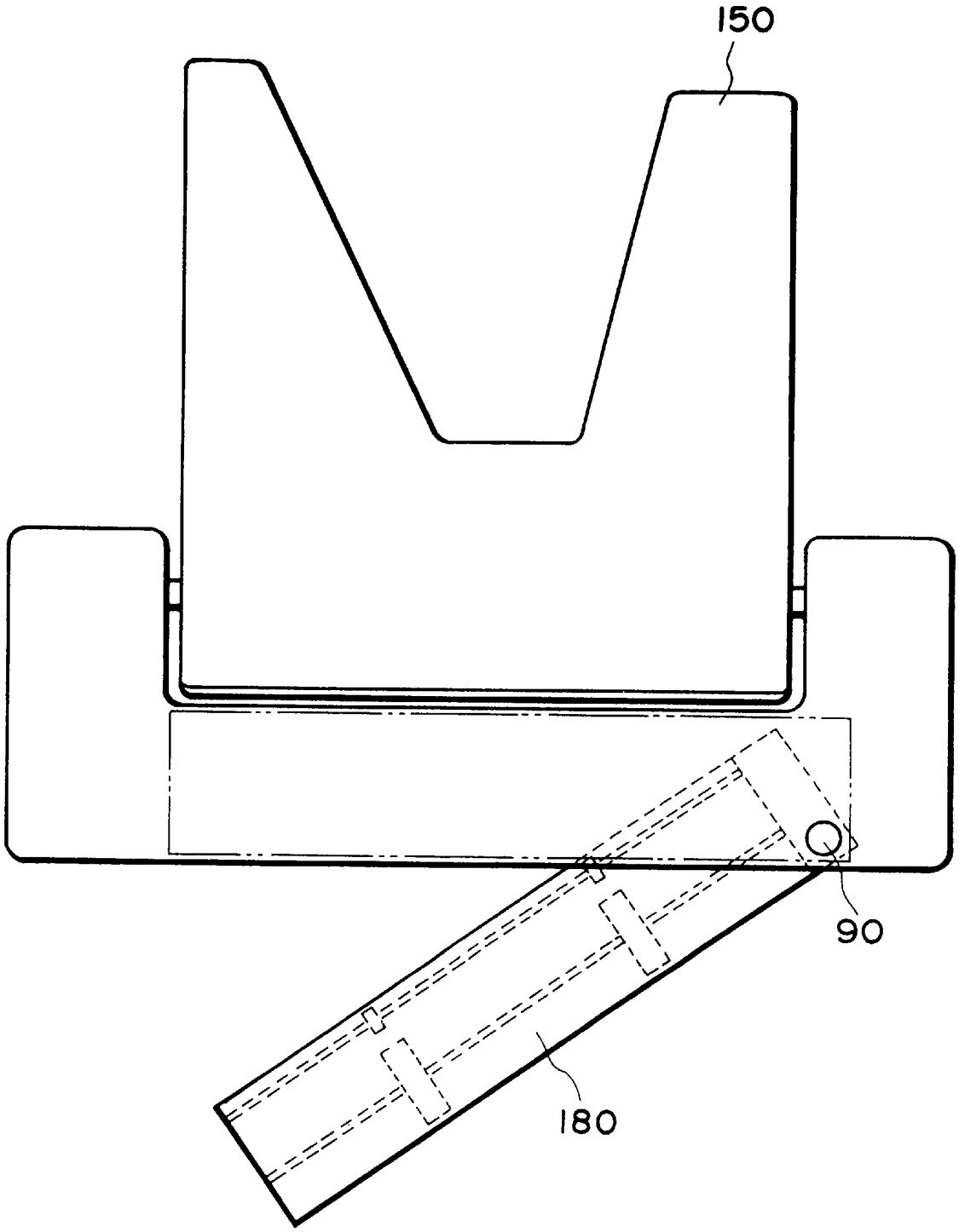
FIG. 5 is a top view of a sheet post-treatment apparatus according to a second embodiment of the present invention.

In the above-mentioned embodiment, while an example that the convey unit can be rocked around the lower shaft to separate it from the bin unit was explained, in the second embodiment, as shown in FIG. 5, the convey unit 180 may be rocked around a vertical shaft 90. Also in this case, the same technical effect as that of the first embodiment can be achieved.

Next, a third embodiment of the present invention will be explained.

Figure 6:
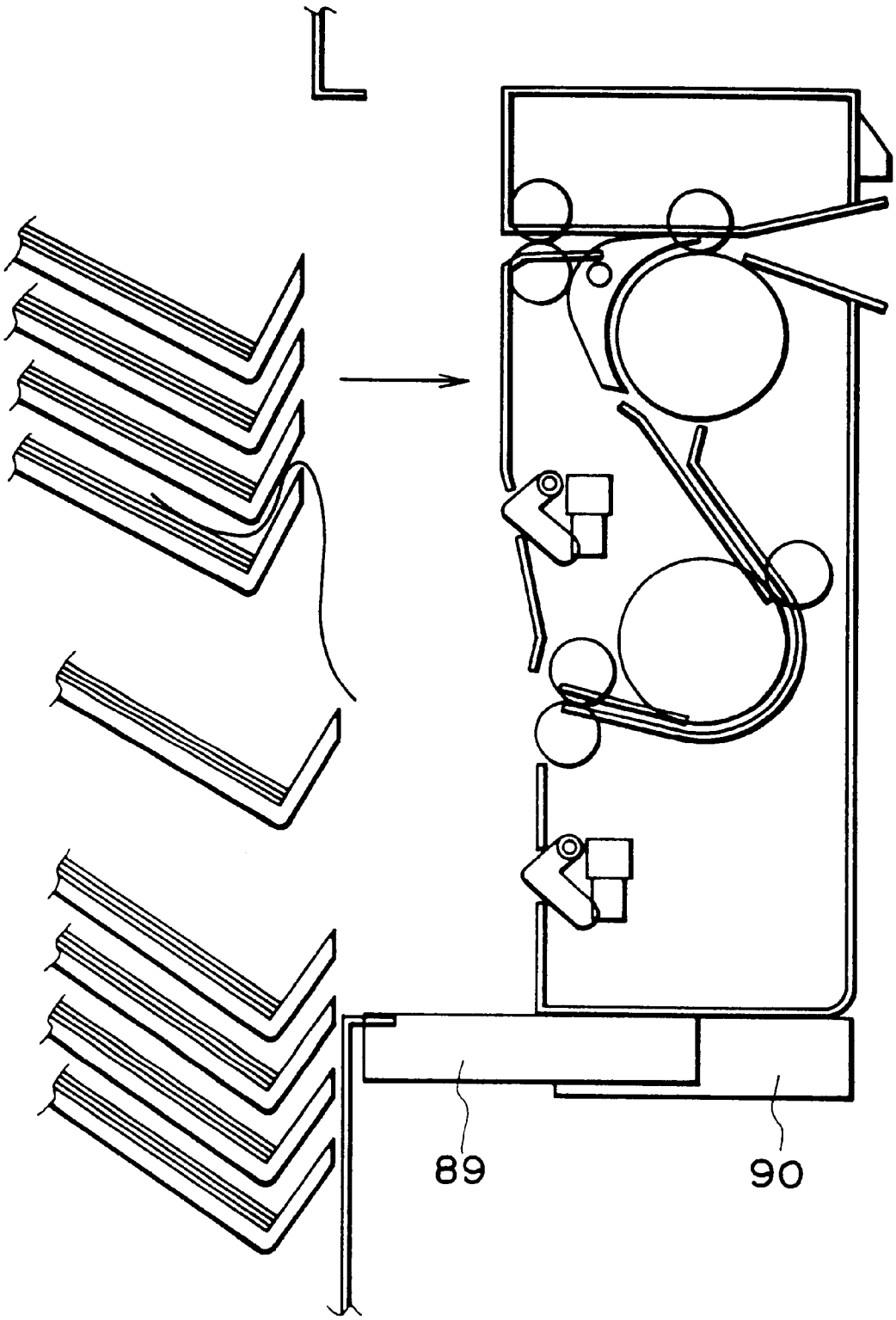
FIG. 6 is an enlarged sectional view of a convey unit and a bin unit of the sheet post-treatment apparatus according to a third embodiment of the present invention.

Alternatively, in a third embodiment, as shown in FIG. 6, the bin unit is connected to the convey unit via slide rails 89, 90 so that, when the jammed sheet is removed, the convey unit can be shifted horizontally with respect to the bin unit. Further, in order to disconnect the bin unit and the convey unit from each other, the bin unit may be separated from the convey unit.

Figure 7:
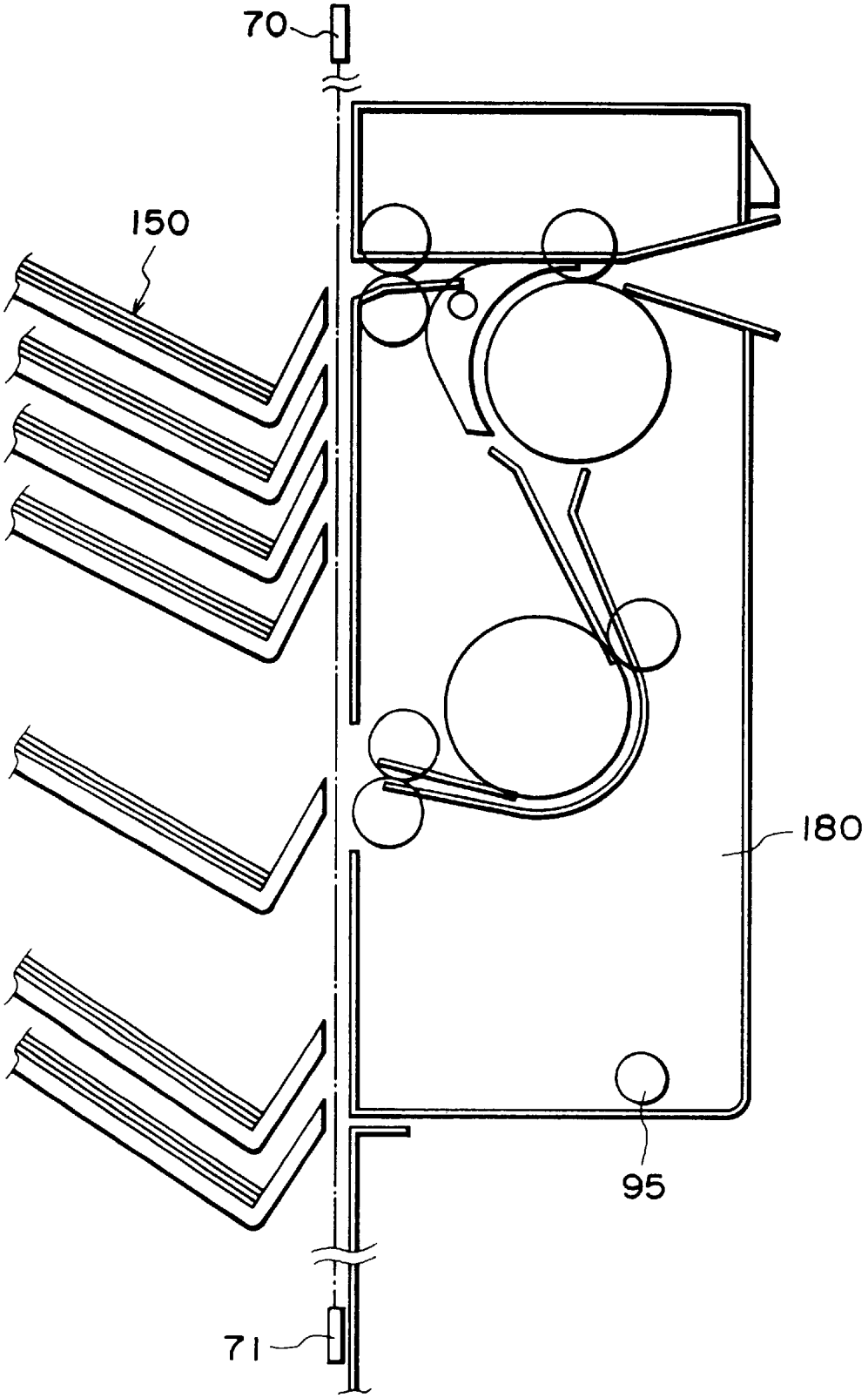
FIG. 7 is an enlarged sectional view of a convey unit and a bin unit of the sheet post-treatment apparatus according to a fourth embodiment of the present invention.
Figure 8:
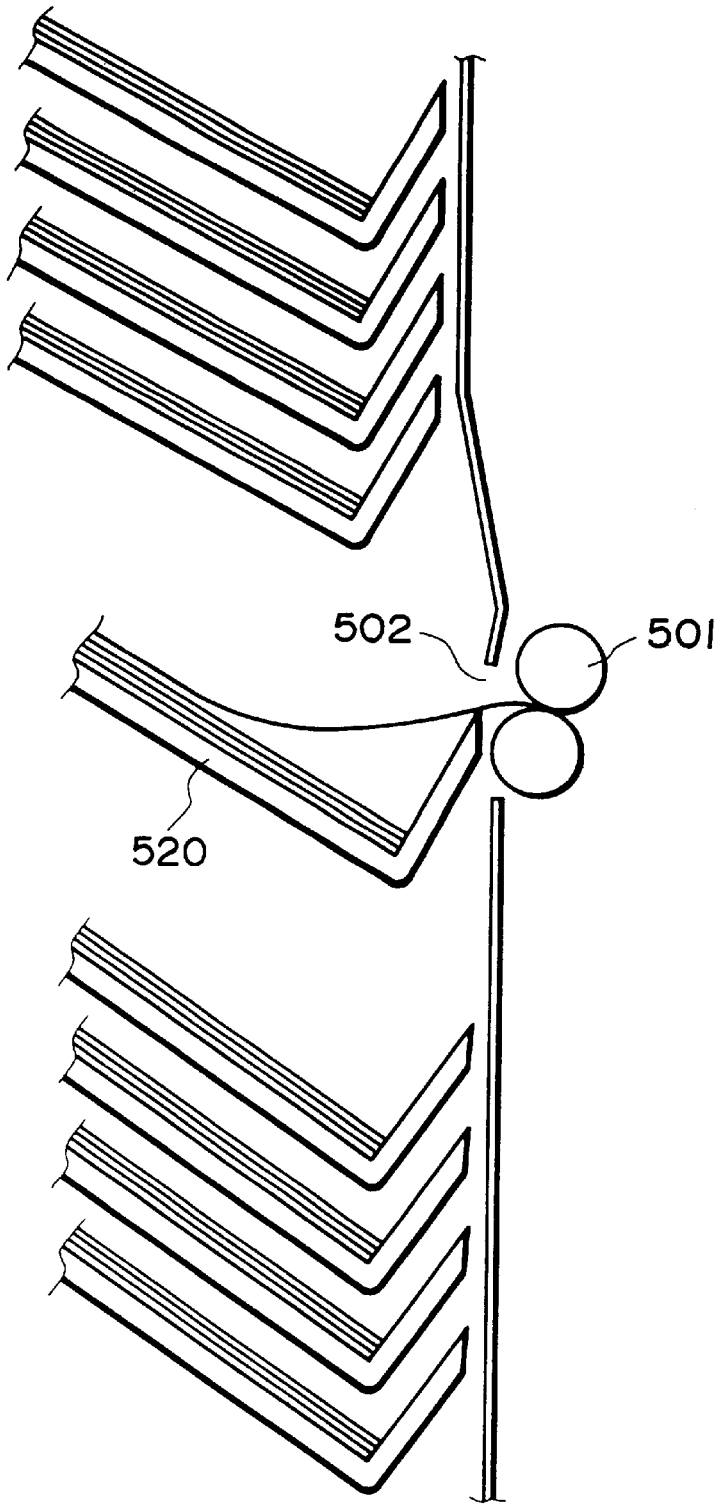
FIG. 8 PRIOR ART
FIGS. 8 to 10 are enlarged sectional views of a convey unit and a bin unit of a conventional sheet post-treatment apparatus.
Figure 9:
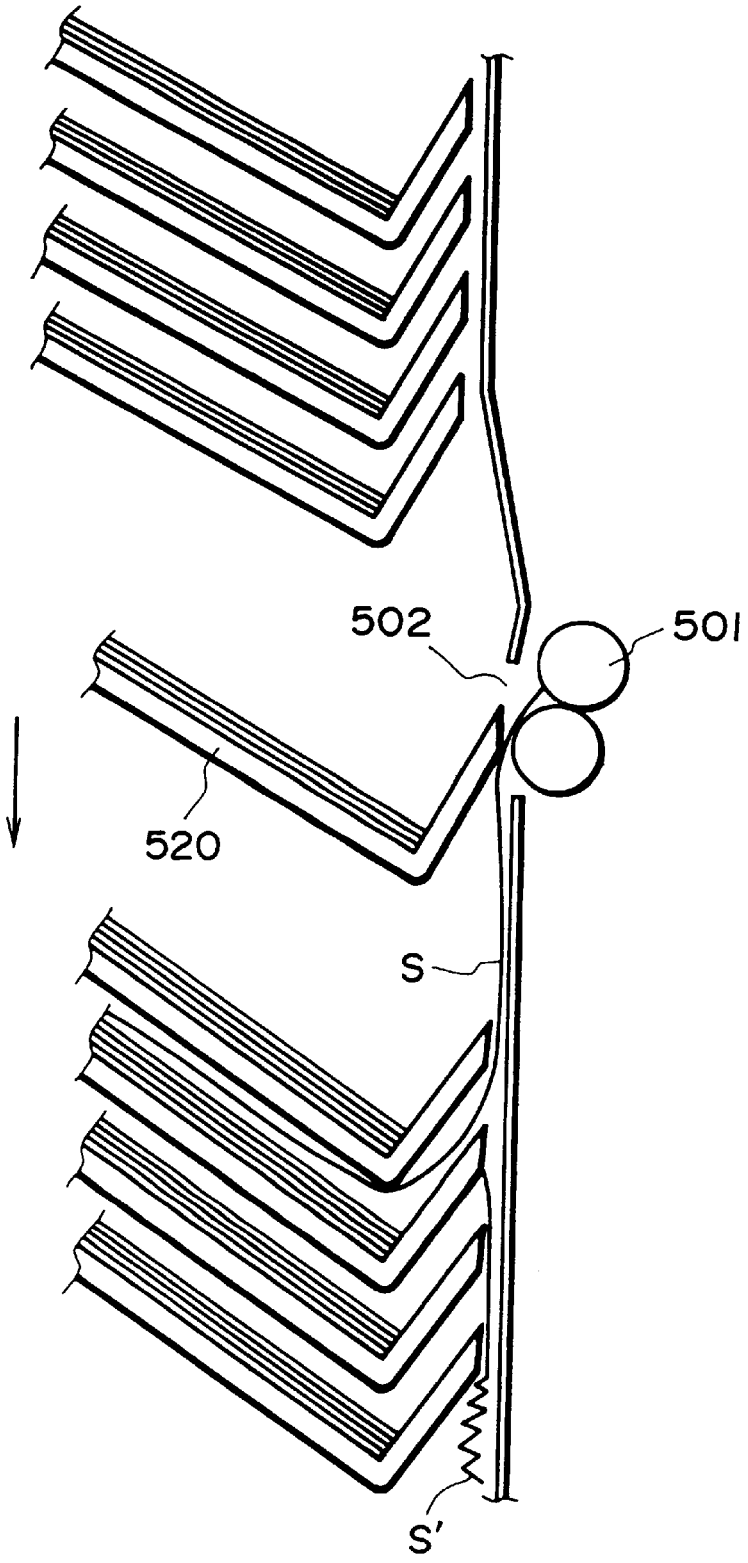
FIG. 9 PRIOR ART
Figure 10:
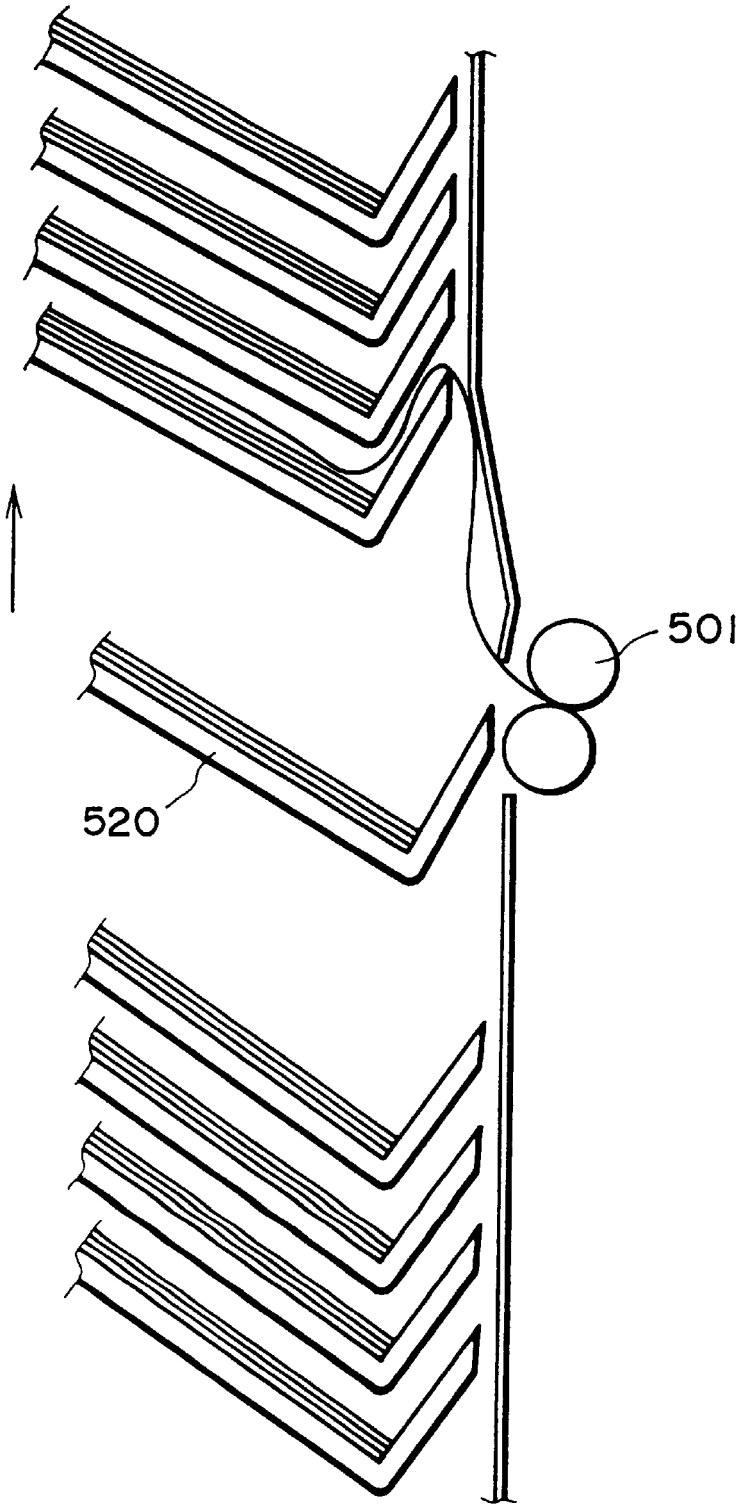
FIG. 10 PRIOR ART

Next, a fourth embodiment of the present invention will be explained with reference to FIG. 7.

In this fourth embodiment, a sorter is provided with an optical sensor. A light emitting portion 70 of the optical sensor is arranged above and between the convey unit 180 and the bin unit 150, and a light receiving portion 71 of the optical sensor is arranged below and between the convey unit 180 and the bin unit 150. With this arrangement, although a light path from the light emitting portion to the light receiving portion of the optical sensor is not blocked by the sheet when the sheet is correctly received in the bin. However, if the sheet enters between the bin unit 150 and the convey unit 180, since the light path is blocked by the jammed sheet, the abnormal condition can be detected.

In this embodiment, while the light emitting portion was arranged above the units and the light receiving portion was arranged below the units, the light emitting portion may be arranged below and between the bin unit and the convey unit and the light receiving portion may be arranged above and between the bin unit and the convey unit. Alternatively, both of the light emitting portion and the light receiving portion may be arranged either above or below the units in such a manner that the light emitted from the light emitting portion is reflected by a reflection plate arranged at the other side to be incident to the light receiving portion. Also in this case, the same technical effect can be achieved.

Further, in the above-mentioned embodiments, only the bin unit was shiftable in the vertical direction, both the bin unit and the convey unit may be shiftable, or the bin unit may be fixed and the convey unit may be shiftable. In the latter case, the entire convey portion may be shifted in the vertical direction, or only the discharge opening 15 and a portion of the sheet path 6*a* may be shifted in the vertical direction (for example, refer to U.S. Pat. Nos. 4,900,009 (issued on Feb. 13, 1990), 5,154,411 (issued on Oct. 13, 1992) and 4,478,406 (issued on Oct. 23, 1984).

Further, while an example that the presence of the sheet is detected if the sheet enters into the clearance between the sheet convey portion and the sheet receiving portion was explained, the fact that the sheet is straddling between the sheet convey portion and the sheet receiving portion may be detected. In this case, by inhibiting the shifting movement of the bin unit or the convey portion on the basis of the detection, the sheet jam can be prevented from occurring.

What is claimed is:

1. A sheet post-treatment apparatus comprising a sheet convey portion having a sheet path and a sheet discharge opening, and a sheet receiving tray portion having a plurality of sheet receiving tray means arranged in one direction, wherein a sheet is transferred from said sheet convey portion to said sheet receiving tray portion, and said sheet convey portion and said sheet receiving tray portion can be shifted relative to each other in said one direction in every transferring step of the sheet;

characterized by that detection means is provided for detecting the sheet existing between said sheet convey portion and said sheet receiving tray portion.

2. A sheet post-treatment apparatus according to claim 1, wherein said detection means is arranged above or below, or above and below said sheet discharge opening so that said detection means can detect and the sheet existing between said sheet convey portion and said sheet receiving tray portion.

3. A sheet post-treatment apparatus according to claim 1, wherein said sheet convey portion and said sheet receiving tray portion are constructed to be separated from each other.

4. A sheet post-treatment apparatus according to claim 1, wherein said sheet receiving tray means is arranged in many steps in a vertical direction and can be shifted in the vertical direction, and wherein said sheet convey portion has an outer wall, and said sheet receiving tray means is guided for shifting movement along said outer wall included in said sheet discharge opening.

5. A sheet post-treatment apparatus according to claim 4, wherein said sheet receiving tray means form a sheet receiving portion directing toward a vertical direction at a side of said sheet discharge opening, and a gap is generated between an outer surface of said sheet receiving portion and said outer wall.

6. An image forming apparatus comprising an image forming portion, a sheet convey portion for conveying a sheet on which an image was formed by said image forming portion, and a sheet receiving tray portion having a plurality of sheet receiving tray means arranged in one direction, wherein the sheet is transferred from said sheet convey portion to said sheet receiving tray portion, and said sheet convey portion and said sheet receiving tray portion can be shifted relative to each other in said one arranged direction in every transferring step of the sheet;

characterized by that detection means is provided for detecting the sheet existing between said sheet convey portion and said sheet receiving tray portion.

7. An image forming apparatus according to claim 6, wherein said sheet receiving tray means is arranged in many steps in a vertical direction and can be shifted in the vertical direction, and wherein said sheet convey portion has a sheet discharge opening, a sheet path and an outer wall, and said sheet receiving tray means is guided for shifting movement along said outer wall included in said sheet discharge opening.

8. An image forming apparatus according to claim 7, wherein said sheet receiving tray means form a sheet receiving portion directing toward a vertical direction at a side of said sheet discharge opening, and a gap is generated between an outer surface of said sheet receiving portion and said outer wall.

* * * * *

UNITED STATES PATENT AND TRADEMARK OFFICE

CERTIFICATE OF CORRECTION

PATENT NO. : 5,961,110
DATED : October 5, 1999
INVENTOR(S) : Seiichiro Adachi et al.

It is certified that error appears in the above-identified patent and that said Letters Patent is hereby corrected as shown below:

Column 1,
Line 11, “facilitate” should read -- facilitates --; and
Line 16, “a” should be deleted.

Column 2,
Line 62, “acting” should read -- imparting --.

Column 5,
Line 16, “although” should be deleted.

Column 6,
Line 11, “and” should be deleted.

Signed and Sealed this

Fifth Day of October, 2004

JON W. DUDAS
*Director of the United States Patent and Trademark Office*